United States Patent [19]

van den Berg

[11] 4,245,020

[45] Jan. 13, 1981

[54] METHOD OF MAKING A DISPLAY SCREEN FOR A COLOR TELEVISION DISPLAY TUBE USING CHARGED PHOTOCONDUCTIVE LAYER

[75] Inventor: Jacob van den Berg, Eindhoven, Netherlands

[73] Assignee: U.S. Philips Corporation, New York, N.Y.

[21] Appl. No.: 15,548

[22] Filed: Feb. 26, 1979

[30] Foreign Application Priority Data

Mar. 21, 1978 [NL] Netherlands ..... 7803025

[51] Int. Cl.[3] ..... G03G 13/01

[52] U.S. Cl. ..... 430/24; 430/25; 430/28; 430/42; 430/35; 430/942; 430/53; 427/68

[58] Field of Search ..... 96/1, 1.5; 427/17, 64, 427/68; 430/28, 23, 24, 29, 942, 35, 53

[56] References Cited

U.S. PATENT DOCUMENTS 4,065,306 12/1977 Ross et al. ..... 96/1 R 4,095,134 6/1978 Stirk ..... 96/1 R X

*Primary Examiner*—John D. Welsh

*Attorney, Agent, or Firm*—Thomas A. Briody; William J. Streeter; Laurence A. Wright

[57] ABSTRACT

A method of making a display screen for a color television display tube in which a photoconductive layer on the window portion of the tube is provided with a uniform charge which may be either positive or negative. A charge pattern is then formed on that layer by scanning it with an electron beam passing through an apertured color selection electrode. The energy of the beam is such that the average depth of penetration of the electrons is greater than the thickness of the photoconductive layer so that the charge disappears at the regions struck by the beam. The remaining charge pattern is developed with a suspension of charged phosphor particles. By repeating this process, patterns of red, green and blue luminescent phosphor particles can be successively provided to form the display screen. It is also possible to scan the layer simultaneously or successively by three electron beams and to develop the resultant charge pattern with a light-absorbing pigment.

7 Claims, 1 Drawing Figure

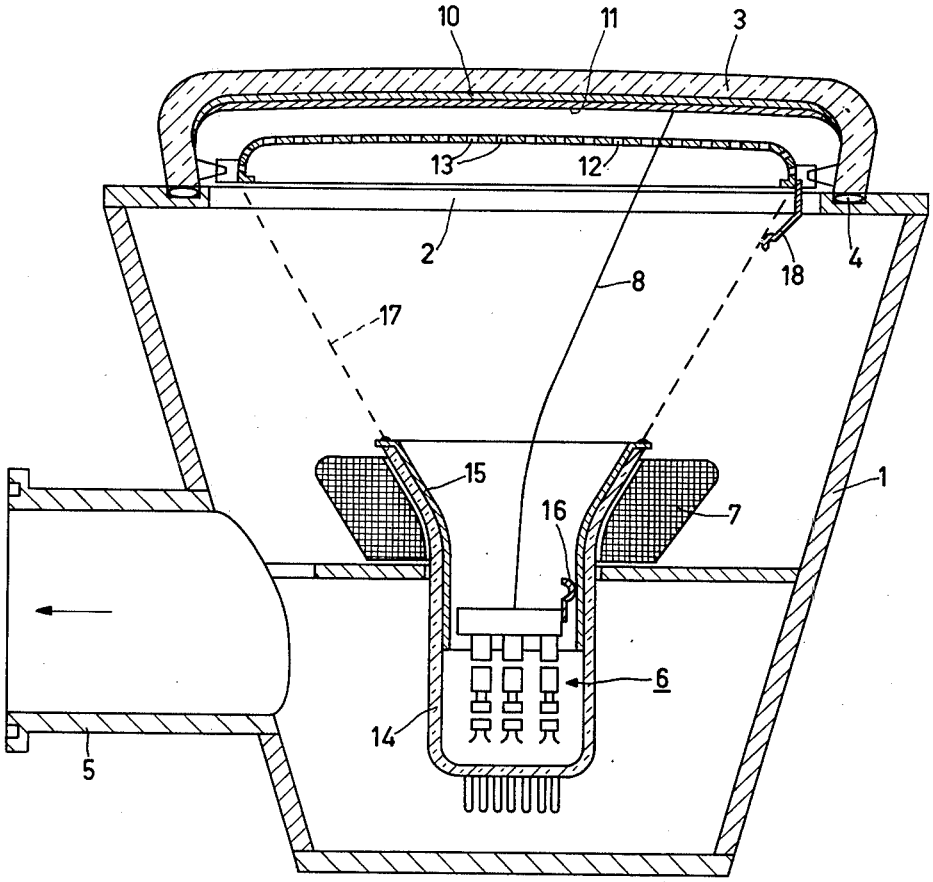
10
11
3
13
12
2
4
18
8
17
15
1
16
7
6
14
5

METHOD OF MAKING A DISPLAY SCREEN FOR A COLOR TELEVISION DISPLAY TUBE USING CHARGED PHOTOCONDUCTIVE LAYER

The invention relates to a method of making a display screen for a colour television display tube in which a photoconductive layer is provided on a conductive layer. A charge pattern is then formed on the photoconductive layer by an electron beam which is scanned across an apertured colour selection electrode positioned at a short distance in front of the display screen. The charge pattern is then developed with electrically charged particles.

The invention also relates to a colour television display tube made in accordance with such a method.

Such a method is disclosed in Dutch Patent Application No. 7512513. In this known method, a conductive layer is first provided on a window portion of the tube and then an electron-absorbing layer is provided on the conductive layer. The electron-absorbing layer is preferably also photoconductive. The electron-absorbing layer is then exposed to radiation through the apertured colour selection electrode by means of an electron beam which scans the side of the colour selection electrode remote from the window. The average depth of penetration of the electrons is smaller than or equal to the thickness of the electron-absorbing layer. In this manner, an electrostatic potential image is formed on the electron-absorbing layer, which potential image forms a reproduction of the pattern of the apertured colour selection electrode. This potential image is developed by a suspension of phosphor particles which are charged positively by the addition of a surface-active stabilizer. The charge, if any, remaining after development is removed by a short exposure to, for example, ultraviolet light. By repeating this process, patterns of red, green and blue luminescing phosphor particles can successively be provided.

According to the method in the above-mentioned Patent Application it is also possible to form a light-absorbing layer which is provided with apertures which are then provided with the luminescing phosphor particles. For this purpose, the electron-absorbing layer is irradiated simultaneously or successively with three electron beams and the resulting potential image is then developed with a negatively charged light-absorbing pigment which covers the regions between the charged areas.

The energy of the electron beam for forming the charge pattern should be as large as possible so as to minimize the influence of disturbing fields. Disturbing fields, for example the earth's magnetic field, cause deflection errors of the electron beam, which result in a shift of the phosphor pattern with respect to the desired phosphor pattern.

Since the average depth of penetration of the electrons in the method disclosed in Application No. 7512513 must be smaller than or equal to the thickness of the electron-absorbing layer, the energy of the electron beam is determined by the thickness of the electron-absorbing layer. Although the Patent Application states that the thickness of the electron-absorbing layer may be from 2 to 10 μm, the thickness of the electron-absorbing layer in practice is restricted to a range of 2 to 4 μm. The provision of the electron-absorbing layers of a thickness exceeding 4 μm has the disadvantage in that the homogeneity of the resultant layers leaves something to be desired. In addition, for electron absorbing layers with a thickness exceeding 4 μm, the adhesion of the luminescent phosphor particles to the display screen is considerably reduced during the so-called annealing of the electron-absorbing layer. In the case of layer thicknesses of from 2 to 4 μm, the energy of the electron beam is restricted to range of 6 to 11 KeV. The influence of the earth's magnetic field on the deflection of the electron beam during formation of the electrostatic potential image is not negligibly small when electron beams having such energies are used.

Another method is disclosed in U.S. Pat. No. 2,682,478. In this method, a uniform positive surface charge is provided on a display window, which is then selectively discharged by scanning the display window with electron beams, the negative charge of the electrons of the beam neutralizing the positive surface charge. The positive charge remains on the areas not hit by the electron beams. The charge pattern thus obtained is developed by means of a suspension of negatively charged phosphor particles. Patterns of red, green and blue luminescing phosphor particles can successively be provided by repeating the method.

U.S. Pat. No. 3,475,169 discloses a method in which a charge pattern is provided on a uniformly charged photoconductive layer by exposure to light. This method suffers from the disadvantage that a correction lens is required so as to bring the virtual position of the light source used in agreement with the position of the deflection point of the electron beams in the operating tube.

It is the object of the invention to provide a method of making a colour television display tube in which irradiation is carried out by means of electron beams but in which the influence of disturbing fields, for example the earth's magnetic field, on the deflection of the electron beams is negligibly small.

For that purpose, according to the invention a method of the kind mentioned in the first paragraph is characterized in that the photoconductive layer is provided with a substantially uniform surface charge and that the average depth of penetration of the electron beam exceeds the thickness of the photoconductive layer.

In the method according to the invention the photoconductive layer is provided with a uniform charge. This uniform charge may be either positive or negative which was not deemed possible before the present invention. In the case of a uniform positively charged photoconductive layer, charge is removed in the places hit by the scanning electron beam, the average depth of penetration of which is larger than the thickness of the photoconductive layer. The charge image formed in this manner is developed by means of a suspension of positively charged phosphor particles.

In the case of a uniform negatively charged photoconductive layer it was unexpectedly found possible to create a conduction in the layer by means of an electron beam having an average depth of penetration exceeding the thickness of the photoconductive layer. The negative charge remains in the areas which have not been hit by the electron beam. The charge pattern thus obtained is developed by means of a suspension of negatively charged phosphor particles.

Since the average depth of penetration of the electrons must exceed the thickness of the photoconductive layer, the energy of the electron beam must be sufficiently large. With layer thicknesses used in practice the electron beams have such a high energy that the influence of disturbing fields, for example the earth's magnetic field, is negligibly small.

The method according to the invention has the additional advantage in that the provision of the charge pattern can be carried out in a shorter period of time than in the method disclosed in U.S. Pat. No. 2,682,478 in which the surface charge is neutralized.

By repeating the method of the invention, except for the provision of the conductive layer and the photoconductive layer, which need be carried out only once, it is possible to provide patterns of phosphor particles luminescing successively in red, green and blue.

A method according to the invention may also be used for providing a light-absorbing layer having apertures for the luminescing areas. As is known, a light-absorbing layer increases the contrast of the observed image. For this purpose, the uniformly charged photoconductive layer is irradiated simultaneously or successively by means of the electron beams so that a so-called matrix pattern is formed on the photoconductive layer by areas on which charge remains after exposure. The charge pattern is then developed by means of a light-absorbing pigment.

By means of a method according to the invention it is also possible to reproduce the pattern of apertures of the colour selection electrode on the photoconductive layer in an enlarged or widened manner by varying the discharge time of the electron beam. The scanning of the window by means of the electron beam is usually carried out according to a pattern of parallel lines, the whole window portion being scanned 25 times per second. The scanning time of the electron beam can now be adjusted so that the size of the discharged areas on the photoconductive layer becomes larger than the apertures in the colour selection electrode.

The invention will now be described in greater detail with reference to the accompanying drawing the sole FIGURE of which shows a device for carrying out the method according to the invention.

The device shown comprises a metal housing 1 which is provided on its upper side with an opening 2. The window portion 3 of a colour television display tube is positioned above the opening 2. A rubber sealing ring 4 ensures a vacuum-tight seal between the window portion 3 and the housing 1. The housing 1 further comprises a part 5 which can be connected to a vacuum pump to evacuate the device. Mounted in the housing 1 are an electron gun 6 and a set of deflection coils 7 which deflect an electron beam 8 generated by the electron gun 6 over the window portion 3. In order to rapidly achieve a sufficiently low pressure in the device, the deflection coil 7 is impregnated with a synthetic resin. The electron gun 6 is of known construction to generate three beams which are also used in colour television display tubes. However, the electron beams may also be switched on and off separately so as too be able to separately carry out the exposure for each phosphor pattern to be provided. The position of the electron gun 6 with respect to the window portion 3 is identical to the position of the electron gun in the final tube. The same applies to the set of deflection coils 7. The electron gun 6 is mounted in a glass neck 14 which has an internal conductive coating 15. The last electrode of the electron gun 6 is connected to the conductive coating 15 by means of a contact spring 16. A metal cone 17 of gauze which is connected to the colour selection electrode 12 by means of a contact spring 18 is situated between the conductive coating 15 and the colour selection electrode 12. The space between the last electrode of the electron gun 6 and the colour selection electrode 12 thus is an equipotential space.

A method according to the invention is carried out as follows by means of the device shown.

First a transparent conductive layer 10 and a photoconductive layer 11 are provided on a window portion 3. The photoconductive layer 11 is then provided in known manner with a uniform charge which may be either positive or negative, for example, as described in U.S. Pat. No. 3,475,169. The layer 10 has a thickness of from 2 to $6\times10^{-2}$ $\mu$m and consists of vapour-deposited metal, for example, magnesium or chromium nickel. The layer 11 has a thickness of from 2 to 4 $\mu$m and consists, for example, of poly-N-vinylcarbazole. The secondary emission factor of the layer 11 must be smaller than 1.

The colour selection electrode 12 with apertures 13 is then mounted in the window portion 3 and the window portion 3 is then placed on the housing 1. The device is then evacuated to a pressure of $10^{-5}$ mm Hg.

An electron beam 8 is then produced with an energy of 15 to 25 KeV by the electron gun 6. The energy of the electrons must be sufficiently high for the average depth of penetration to exceed the thickness of the photoconductive layer 11. The influence of disturbing fields, for example the earth's magnetic field, is negligibly small at such high energies. The colour selection electrode is scanned by the electron beam by means of the set of deflection coils 7. The current through the deflection coils should be adapted, of course, to the energy of the electron beam. The configuration of the magnetic field generated by the deflection coils should be the same as the magnetic field of the deflection coils in the final tube. The deflection coils 7 are therefore preferably identical to the deflection coils of the final tube.

The scanning by means of the electron beam 8 may be carried out, for example, according to a pattern of parallel lines, the whole window portion being scanned 25 times per second. A discharge time of 5 seconds with a beam current of 50 $\mu$A is necessary for providing the charge pattern. The width of the discharged areas on the photoconductive layer can be controlled by varying the discharge time of the electron beam.

In addition, the size of the discharged areas can be controlled by varying the potential difference between the colour selection electrode 12 and the conductive layer 10, which is known per se from the Dutch Patent Application No. 7512513. The discharged areas on the photoconductive layer 11 are substantially of the same size as the apertures 13 in the colour selection electrode 12 if the conductive layer 10 and the colour selection electrode 12 are at the same potential.

Discharged areas larger than the apertures in the colour selection electrode 12 can be obtained by means of a method disclosed in U.S. Pat. No. 3,527,652, in which a magnetic or electric field is generated between the electron gun 6 and the deflection coils 7, with which field a "rotating" electron beam is obtained.

After provision of the discharge pattern the pressure in the housing 1 is again increased to atmospheric pressure and the window portion 3 is removed. After removal of the colour selection electrode 12 from the window portion 3, a phosphor suspension with phosphor particles which have a charge equal to the original uniform charge of the photoconductive layer 11 is sprayed on the window portion. The charged phosphor particles adhere only to those areas where the charge has been removed by the scanning electron beam. This step is referred to as the development of the charge image. This method is then repeated for phosphor of a second colour and then for a phosphor of a third colour. Suspensions with charged phosphor particles are known per se from U.S. Pat. No. 3,475,169.

By means of a method according to the invention it is also possible to provide a light-absorbing layer on the window portion 3. Such a light-absorbing layer, as is known, increases the contrast of the displayed picture. For that purpose, layer 11 is irradiated successively or simultaneously with the three electron beams generated by the electron gun 6 without intermediate development. The charge pattern is then developed by means of a suspension of charged particles of a light-absorbing pigment whose charge is opposite to the uniform charge originally present on the photoconductive layer 11. The light-absorbing pigment adheres only to those areas where charge remains after irradiation with the three electron beams.

What is claimed is:

1. A method of making a colour display screen for a colour television display tube comprising the steps of applying a conductive layer on a window portion of the tube, applying a photoconductive layer on said conductive layer, providing a substantially uniform surface charge on said photoconductive layer, positioning an apertured colour selection electrode in front of said window portion so that the electrode is adjacent to and spaced from said photoconductive layer, scanning said photoconductive layer with an electron beam passing through the apertures in the colour selection electrode to thereby form a charge pattern on the photoconductive layer, the thickness of said photoconductive layer and the energy of the electrons in the electron beam being such that the average depth of penetration of the electrons in the beam exceeds the thickness of the photoconductive layer, and developing the charge pattern with electrically charged particles.

2. The method according to claim 1 wherein, after said developing step, said surface charge providing and scanning steps are repeated to form a second charge pattern and developing said second charge pattern with charged particles of a type different from said first named particles.

3. The method according to claim 2 wherein the respective charge patterns are developed with phosphor particles luminescing in different colours.

4. The method according to claim 2 wherein said surface charge providing, scanning and developing steps are repeated to successively form three charge patterns which are developed with phosphor particles luminescing in red, green and blue, respectively.

5. The method according to claim 1 wherein said scanning step is carried out with a plurality of electron beams to thereby form a plurality of interdigitating charge patterns and wherein said charge patterns are developed with particles of a light-absorbing material.

6. The method according to claim 1 wherein during said scanning step the charge pattern is formed by discharge of the surface charge at regions on said photoconductive layers struck by said electron beam and wherein the size of said regions is determined by the discharge time of the electron beam.

7. The method according to claim 1 wherein said photoconductive layer is provided with a negative surface charge.

* * * * *